United States Patent [19]

Kralik et al.

[11] 4,423,524

[45] Jan. 3, 1984

[54] SUSPENSION SYSTEM FOR HEADGEAR

[75] Inventors: Douglas R. Kralik; Hal D. Mitchell, both of Rolla, Mo.

[73] Assignee: A-T-O Inc., Willoughby, Ohio

[21] Appl. No.: 238,230

[22] Filed: Feb. 26, 1981

[51] Int. Cl.[3] ..... A42B 3/02

[52] U.S. Cl. ..... 2/416

[58] Field of Search ..... 2/416, 414, 413, 411, 2/425, 417–420, 410

[56] References Cited

U.S. PATENT DOCUMENTS

| | | | |
|---|---|---|---|
| 2,879,513 | 3/1959 | Hornickel et al. | 2/3 |
| 2,921,318 | 1/1960 | Voss et al. | 2/416 X |
| 3,127,615 | 4/1964 | Aileo | 2/416 |
| 3,548,409 | 12/1970 | Aileo | 2/414 |
| 4,106,127 | 8/1978 | Marangoni et al. | 2/416 |
| 4,223,409 | 9/1980 | Lee | 2/414 X |
| 4,286,339 | 9/1981 | Coombs | 2/416 X |

FOREIGN PATENT DOCUMENTS

| | | | |
|---|---|---|---|
| 683718 | 9/1979 | U.S.S.R. | 2/416 |

*Primary Examiner*—Peter P. Nerbun

*Attorney, Agent, or Firm*—Senniger, Powers, Leavitt and Roedel

[57] ABSTRACT

A suspension system for protective headgear comprising a plurality of straps of a relatively inextensible material extending up in the headgear toward but stopping short of the crown of the headgear secured to the headgear at spaced intervals around the inner surface of the headgear. Each strap is formed with transversely extending pockets and has elastically deformable tubes in the pockets enabling extension of the strap within a limited range of extension upon tensioning of the strap, whereby with the headgear worn by a wearer and upon application of an impact load on the top of the headgear, the headgear moves down toward but stops short of engagement with the wearer's head and the tubes in the straps deform to attenuate the shock upon the wearer from the applied load.

22 Claims, 4 Drawing Figures

SUSPENSION SYSTEM FOR HEADGEAR

BACKGROUND OF THE INVENTION

This invention relates to headgear, and more particularly to a suspension system for the crown of protective headgear having a shock attenuation feature.

This invention involves an improvement in suspension systems for protective headgear of the type, such as shown for example in U.S. Pat. Nos. 2,879,513 and 4,106,127, comprising a plurality of straps extending up in a protective shell toward but stopping short of the crown of the shell, the straps being secured to the shell at their lower ends at spaced intervals around the inner surface of the shell and to each other at their upper ends. Each strap has inelastically deformable means for enabling extension of the strap upon being tensioned, so that upon application of an impact load on the top of the headgear the inelastically deformable means deforms to attenuate the shock upon the wearer. In the suspension system disclosed in U.S. Pat. No. 2,879,513, the inelastically deformable means comprises a block of crushable brittle material, such as foamed glass, received in a pocket in each strap which crushes upon tension of a predetermined magnitude being developed in the strap. In the suspension system disclosed in U.S. Pat. No. 4,106,127, the inelastically deformable means comprises a ring of thermoplastic material integrally molded in each strap which elongates upon tensioning of the strap, the ring being permanently deformed upon tension of a predetermined magnitude being developed in the strap. Each of the above-described inelastically deformable means thus provides shock attenuation for only a single impact load of relatively high magnitude and must be replaced after each such load if the suspension system is to provide shock attenuation for a subsequent load. Accordingly, the stated prior art suspension systems are not practical for headgear, such as a football helmet, subject to repeated loads of relatively high magnitude during a relatively short period of time.

SUMMARY OF THE INVENTION

Among the several objects of this invention may be noted the provision of an improved suspension system for the crown of protective headgear which provides a relatively high level of shock attenuation for impact loads applied to the top of the headgear; the provision of such a suspension system comprising elastically deformable means which stores and then releases at least a portion of the energy of an impact load to increase the time period of the shock from the impact load and thus reduce its magnitude; the provision of such a suspension system which provides shock attenuation for repeated impact loads of relatively high magnitude applied during a relatively short time period; the provision of such a suspension system which, if it should suffer a decrease in its shock attenuation capacity in use, is visually detectable as such and may be readily reconditioned; the provision of such a suspension system which is relatively compact and lightweight and allows air to flow into and out of the headgear for ventilation thereof; and the provision of such a suspension system which is relatively simple and economical to manufacture.

In general, the suspension system of this invention for the crown of protective headgear comprises a plurality of strap means of a relatively inextensible material extending up in the outer shell of the headgear toward but stopping short of the crown of the shell, the strap means being secured to the shell at spaced intervals around the inner surface of the shell. Each strap means is formed with a portion thereof permitting extension and contraction of the strap means, and has elastically deformable means associated with said portion enabling extension of the strap means within a limited range of extension upon tensioning of the strap means, whereby with the headgear worn by a wearer and upon application of an impact load on the top of the headgear, the shell moves down toward but stops short of engagement with the head and said elastically deformable means deforms to attenuate the shock upon the wearer from the applied load, and whereby, upon termination of the impact load, each strap means contracts and the shell moves upwardly away from the wearer's head.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
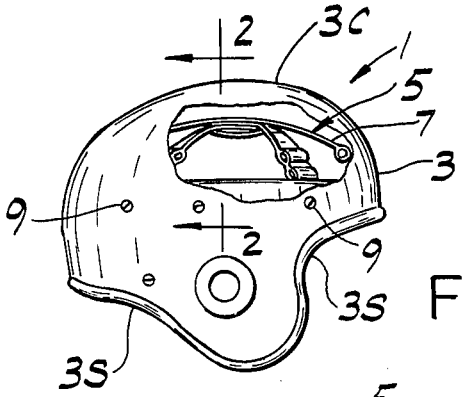
FIG. 1 is a side elevation of protective headgear having an outer shell and a suspension system of this invention within the shell, a portion of the shell being broken away to show certain straps of the system.
Figure 2:
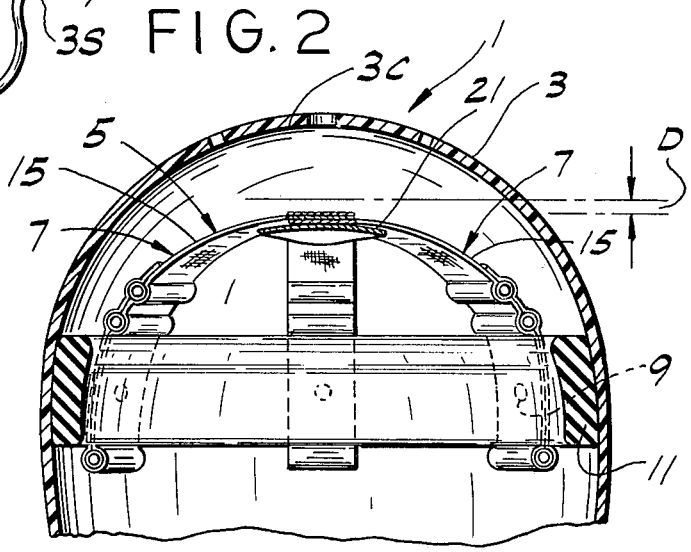
FIG. 2 is an enlarged vertical section on line 2—2 of FIG. 1 showing straps of the suspension system in their contracted state.

Referring first to FIGS. 1 and 2, there is indicated at 1 headgear, such as a football helmet, comprising an outer protective shell 3 of a suitable relatively lightweight plastic material, such as acrylonitrile-butadiene-styrene (ABS) resin or polypropylene having a relatively high impact resistance. A suspension system of this invention, generally indicated at 5, is secured within the shell, the system comprising a plurality of strap means (e.g., six strap means as illustrated) each designated 7 extending up in the shell 3 from adjacent the skirt 3S of the shell toward but stopping short of the crown 3C of the shell to form a cradle adapted to fit the head of a person wearing the headgear for supporting the headgear on the head with the crown of the shell spaced above the top of the head. The strap means 7 of the system are secured at their lower ends to the shell 3 at points spaced circumferentially around the inner surface of the shell by conventional fasteners 9 such as "T" nuts and bolts.

A pad of cushioning material of a suitable closed-cell elastomeric foam such as a foamed vinyl resin shown at 11 in FIG. 2 covers the fasteners 9, the pad providing a snug, comfortable fit of the headgear 1 on the head and preventing engagement of the skirt 3S of the shell and the fasteners 9 with the head. Alternatively, a suspension system such as that described in our co-pending application (Attorney Docket No. RWL 2918) comprising a head band and a plurality of tension members may be secured within the shell adjacent the skirt 3S.

Each strap means 7 together with the strap means diametrically opposite it in the shell 3 comprises a single relatively long strap 15 of a suitable relatively inextensible strip material such as woven cotton, polypropylene or nylon fabric material, extending in a central vertical plane of the headgear from an end thereof below the pad 11 at one side of the shell up toward the crown 3C of the shell and back down to its other end below the pad 11 at the opposite side of the shell. The strip material of each strap is folded back on itself at the ends of the strap to form double-thickness strap portions 17 extending above and below the pad 11. These portions 17 have holes 19 therein for the fasteners 9. The straps 15 intersect each other in overlapping relation adjacent the crown 3C of the shell and are secured together at their intersection as by stitching. To provide additional protection for the top of the wearer's head, a disc 21 of padding material is secured to the straps as by stitching beneath the overlapping portions of the straps.

The two layers of strip material forming the strap portions 17 of each strap are stitched together along lines of stitching 23 extending transversely of the strap at spaced intervals along the strap to form a transversely extending pocket 25 below the pad 11 (i.e., in the lower portion of strap means 7); and a plurality of pockets 27 (e.g., two pockets as illustrated) above the pad 11 (i.e., in the upper portion of strap means 7).

In each of the pockets 27 there is provided elastically deformable means 29, which when unstressed, expands the pocket (i.e., holds the sides of the pocket apart) and which by reason of being compressible (squeezable) to a generally flattened condition upon tensioning the strap, enables extension of each strap within a limited range and thus the extension of the suspension system 5 within a limited range of extension illustrated at D in FIG. 2. Thus, with the headgear 1 worn by a wearer and upon application of an impact load of relatively high magnitude on the top of the headgear, the shell 3 may move down toward the head a distance corresponding to the distance D, with the elastically deformable means 29 in the pockets 27 being deformed (squeezed) to attenuate the shock upon the wearer from the applied load. Upon termination of the impact load, the elastically deformable means 29 in the straps return to their undeformed shape, the straps contract and the shell moves back up to the position on the head it normally occupies.

Figure 3:
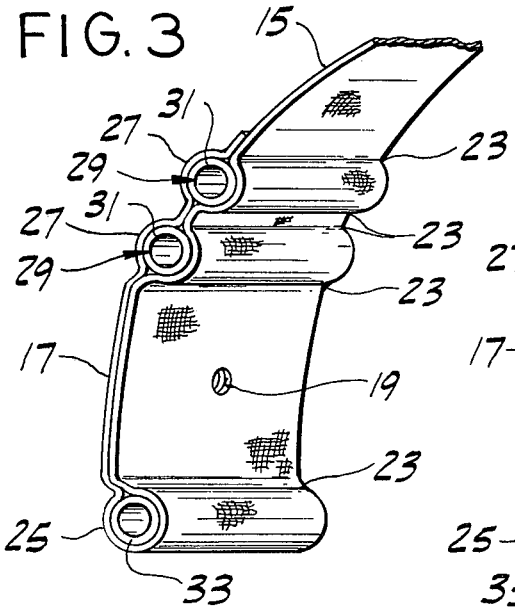
FIG. 3 is an enlarged perspective showing part of a strap in its contracted state.
Figure 4:
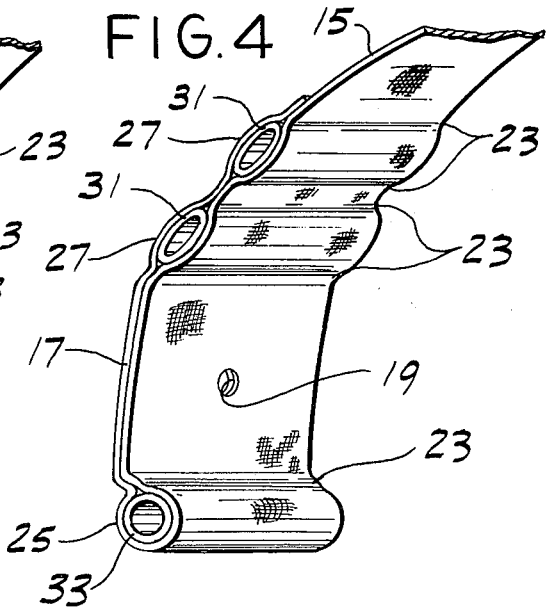
FIG. 4 is a view similar to FIG. 3 showing the strap extended.

The elastically deformable means 29 in each pocket 27 comprises a relatively short generally cylinrical tube 31 of a suitable elastomeric material, such as polybutylene, polyurethane, polyethylene, a polyarylate resin such as that sold under the trade name "Ardel" by Union Carbide Corp., of New York, N.Y., or a synthetic rubber such as that sold under the trade name "Hytrel" by E. I. Du Pont de Nemours & Co., Inc. of Wilmington, Del. Thus, the tubes 31 in effect constitute elastic plugs in the pockets 27. As best illustrated in FIGS. 3 and 4, the tubes deform, upon tensioning of their respective strap, from circular to elliptical section, the tubes being open at both ends to permit air to flow out of the tubes for such deformation. While the tubes are preferably of circular section when unstressed, it is to be understood that they may be of other shapes in section, such as elliptical or rectangular.

The tubes 31 have an outer diameter, in their unstressed condition, such as to provide a tight fit of the tubes within their respective pockets 27 for holding the tubes therein, yet enabling the tubes manually to be pushed out of their pockets. Upon their removal, the tubes may be visually inspected to determine their structural integrity in a manner set forth more fully hereinafter. Also by removing predetermined tubes 31 from their pockets 27, the length of each strap 15 may be varied, and thus the fit of the suspension system 5 and the headgear 1 on the head may be adjusted for the comfort of the wearer.

With the headgear 1 on the wearer's head, the suspension system 5 attenuates the shock upon the wearer from an impact load applied to the top of the headgear by distributing the loading over an increased area of the head and by increasing the period of time during which loading is applied to the head, thereby decreasing the magnitude of the shock (which is a time derivative of the loading). Time being required, upon application of an impact load, for the tensioned straps to deform (laterally squeeze) the tubes 31 from circular to elliptical section and time being required upon termination of the impact load for the tubes to return to circular section, the overall period of time during which loading is applied to the head is increased.

In conrast to the prior suspension systems in which the deformable means for attenuating shock is permanently deformed upon application of an impact load and thus provides shock attenuation for only a single impact load, the suspension system of this invention has the elastically deformable tubes 31 and provides shock attenuation for repeated impact loadings. It is only upon the cracking or fracture of a tube 31, which may occur after a relatively large number of impact loadings, that there is a decrease in the level of shock attenuation provided by the system of this invention. Moreover, the cracking or fracture of a small number of tubes will not result in a significant decrease in the shock attenuation capacity of the system in that the strap having a defective tube also carries other tubes which likely are not defective and is interconnected with the other straps of the system. Also, the suspension system 5 of this invention may be readily inspected to determine if there has been a decrease in its shock attenuation capacity by pushing the tubes out of the pockets 25 in the straps and visually inspecting them for cracks and fractures. The system 5 may be readily reconditioned by replacing any tubes found to be defective.

Cylindrical tubes 33 of the same elastomeric material as the tubes 31 are provided in the pockets 25 in the double-thickness portions 17 of the straps 15 below the pad 11 of cushioning material. The tubes 33 extend along the inner surface of the shell and deform elastically under loads against the sides thereof to assist the pad 11 of cushioning material in attenuating the shock upon the wearer from loads applied against the sides, front and back of the shell. The attenuation of such loads results not from an extension of the portions of the straps below the fasteners 9 but from the lateral squeezing of the tubes 33. In this regard, the tubes 33 may be viewed as cushions interposed between the shell and the wearer's head.

While the shock attenuation system of this invention has been shown and described as being incorporated in a football helmet, it is to be understood that it could be incorporated in other protective headgear, such as aviation helmets, military helmets, and industrial hardhats.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A suspension system for the crown of protective headgear having an outer shell, said system comprising a plurality of strap means on the inside of the shell secured to the shell at points spaced circumferentially around the shell and extending upwardly from said points of securement toward, but stopping short of, the crown of the shell to form a cradle adapted to fit the head of a person wearing the headgear for supporting the headgear on the head with the crown of the shell spaced above the top of the head, each strap means being formed from substantially inextensible strip material and having a portion, constituting an upper head-engaging portion, above its respective point of securement to the shell with pocket means therein permitting extension and contraction of the strap means within a limited range of extension and contraction, and elastically deformable means in said pocket means adapted elastically to deform when tension is applied to the strap means to extend it, as when an impact load is applied to the crown of the shell when the headgear is on the head, the deformation of said elastically deformable means serving to attenuate the shock on the head from said impact load, said elastically deformable means being adapted to return substantially to its undeformed shape when said tension is removed upon termination of said impact load thereby to contract said strap means in preparation for the application of another impact load to the headgear.

2. A suspension system as set forth in claim 1 wherein said pocket means comprises a pair of pockets extending generally transversely of said upper head-engaging portion of the strap means, and wherein said elastically deformable means comprises a pair of elastically deformable members receivable in said pockets, said members being adapted, on tensioning of the strap means, to be laterally squeezed from an unstressed condition in which they hold the sides of the pockets apart to a generally flattened condition for permitting extension of the strap means, at least one of said members being removable from its respective pocket for varying the length of the strap means to adjust the fit of the headgear on the head.

3. A suspension system as set forth in claim 2 wherein both deformable members of each pair are removable from their respective pockets.

4. A suspension system as set forth in claim 2 wherein said deformable members are relatively short tubes of an elastomeric material.

5. A suspension system as set forth in claim 3 wherein said tube is open at both ends thereof for exit of air on lateral squeezing of the tube.

6. A suspension system as set forth in claim 5 wherein the tube is cylindrical in its unstressed condition.

7. A suspension system as set forth in claim 3 wherein said tube is of polyethylene.

8. A suspension system as set forth in claim 3 wherein the tube is of a polyarylate resin.

9. A suspension system as set forth in claim 3 wherein the tube is of synthetic rubber.

10. A suspension system as set forth in claim 3 wherein the tube is of polyurethane.

11. A suspension system as set forth in claim 3 wherein each strap means comprises two layers of relatively inextensible strip material stitched together at spaced locations to form said pockets.

12. A suspension system as set forth in claim 3 wherein each strap means has a lower portion below its respective point of securement to the shell with a transversely extending pocket.

13. A suspension system as set forth in claim 12 further comprising a tube of elastomeric material receivable in the pocket in said lower portion of said strap means, said tube being elastically deformable under loads applied against the side of the tube.

14. A shock attenuation system comprising strap means of a substantially inextensible material having pocket means therein for permitting extension and contraction, and elastically deformable means receivable in said pocket means, said elastically deformable means being adapted elastically to deform when tension is applied to the strap means to extend it, as when an impact load is applied to the system, the deformation of said means serving to attenuate the shock from said applied impact load, said elastically deformable means being adapted to return sustantially to its undeformed shape when said tension is removed from the strap means upon termination of said impact load thereby to effect contraction of said strap means, said pocket means comprising a pair of pockets extending generally transversely of the strap means, said elastically deformable means comprising a pair of elastically deformable members receivable in said pockets, said members being selectively removable from their respective pockets for varying the length of the strap means and for permitting visual inspection of the members.

15. A shock attenuation system as set forth in claim 14 wherein said elastically deformable members are tubes of an elastomeric material.

16. A suspension system as set forth in claim 15 wherein each tube is open at both ends thereof.

17. A suspension system as set forth in claim 16 wherein the tube is cylindrical in its unstressed condition.

18. A suspension system as set forth in claim 15 wherein said tube is of polyethylene.

19. A suspension system as set forth in claim 15 wherein the tube is of a polyarylate resin.

20. A suspension system as set forth in claim 15 wherein the tube is of synthetic rubber.

21. A suspension system as set forth in claim 15 wherein the tube is of polyurethane.

22. A suspension system as set forth in claim 14 wherein said strap means comprises two layers of relatively inextensible strip material stitched together at spaced locations to form said pockets.

* * * * *

UNITED STATES PATENT AND TRADEMARK OFFICE

CERTIFICATE OF CORRECTION

PATENT NO. : 4,423,524

DATED : January 3, 1984

INVENTOR(S) : Douglas R. Kralik; Hal D. Mitchell

It is certified that error appears in the above—identified patent and that said Letters Patent is hereby corrected as shown below:

Claim 5, line 54, "3" should read -- 4 -- and "said" should read -- each --. Claim 6, line 59, "the" should read -- each --. Claim 7, line 60, "3" should read -- 4 --; line 61, "tube" should read -- tubes --, "is" should read -- are --. Claim 8, line 1, "3" should read -- 4 --; line 2, "the" should read -- said --, "tube" should read -- tubes -- and "is" should read -- are --. Claim 9, line 3, "3" should read -- 4 --; line 4, "the" should read -- said --, "tube" should read -- tubes -- and "is" should read -- are --. Claim 10, line 5, "3" should read -- 4 --; line 6, "the" should read -- said --, "tube" should read -- tubes -- and "is" should read -- are --.

Claim 19, line 52, "the" should read -- said --, "tube" should read -- tubes -- and "is" should read -- are --. Claim 20, line 54, "the" should read -- said --, "tube" should read -- tubes -- and "is" should read -- are --. Claim 21, line 56, "the" should read -- said --; "tube" should read -- tubes -- and "is" should read -- are --.

Signed and Sealed this

*Fifth* Day of *February 1985*

[SEAL]

*Attest:*

DONALD J. QUIGG

*Attesting Officer* *Acting Commissioner of Patents and Trademarks*